United States Patent [19]

Bertonneau

[11] Patent Number: 4,645,228

[45] Date of Patent: Feb. 24, 1987

[54] COUPLER FOR ASSEMBLING SEGMENTED SKIS

[76] Inventor: Gerald R. Bertonneau, 1321 Azalea Ave., Ontario, Calif. 91762

[21] Appl. No.: 782,090

[22] Filed: Sep. 30, 1985

[51] Int. Cl.[4] ..... A63C 5/02

[52] U.S. Cl. ..... 280/603; 403/311; 403/331; 403/407.1

[58] Field of Search ..... 280/603, 633; 403/300, 403/311, 313, 331, 405.1, 407.1

[56] References Cited

U.S. PATENT DOCUMENTS

| | | | |
|---|---|---|---|
| 1,444,996 | 2/1923 | Anderson | 403/405.1 |
| 2,545,209 | 3/1951 | Meehan | 280/603 |
| 3,026,546 | 3/1962 | Kakes | 280/603 |
| 3,314,687 | 4/1967 | Tiesler | 280/617 |
| 3,456,968 | 7/1969 | Nichols | 403/407.1 |
| 3,819,198 | 6/1974 | Groves | 280/603 |
| 3,884,315 | 5/1975 | Fox | 280/603 |
| 4,076,265 | 2/1978 | Eash, II | 280/11.27 |
| 4,458,912 | 7/1984 | Bertonneau | 280/603 |
| 4,498,802 | 2/1985 | Del Tufo et al. | 403/300 |
| 4,544,301 | 10/1985 | Lake, Jr. et al. | 403/405.1 |

FOREIGN PATENT DOCUMENTS

| | | | |
|---|---|---|---|
| 2756148 | 6/1978 | Fed. Rep. of Germany | 280/603 |

*Primary Examiner*—John J. Love
*Assistant Examiner*—Eric D. Culbreth
*Attorney, Agent, or Firm*—Robert Louis Finkel

[57] ABSTRACT

A pair of plates each having an internally threaded boss in its base and upturned flanges along its sides are fixed to the upper surface of adjacent segments of a segmented ski. A pair of lips formed on a rigid slide bracket loosely engage axially aligned lips formed on the flanges. A resilient shim is interposed between the lips on the slide bracket and those on the flanges. A pair of screws carried by the slide bracket and registering with the threaded bosses secure the slide bracket to the plates, thereby rigidly joining the ski segments.

6 Claims, 6 Drawing Figures

COUPLER FOR ASSEMBLING SEGMENTED SKIS

BACKGROUND OF THE INVENTION

1. Field of the Invention

This invention relates to skis and more particularly to skis that comprise two or more separable segments. Specifically, it is concerned with a method and means for assembling and disassembling segmented skis which are intended for use on snow.

2. Prior Art

Those closely associated with snow skiing have long recognized the many advantages inherent in skis made up of segments which can readily be assembled and disassembled. Such skis are far easier to store and transport than conventional one-piece skis. The ability to separate the dismantled segments, or to lock them in an automobile trunk or in a relatively small storage space substantially reduces their exposure to theft. For mountaineering, forestry, and military applications the construction greatly facilitates back packing, climbing, and parachuting.

Segmented skis can be modified with ease. By substituting apropriate component sections, such skis can be shortened or lengthened, stiffened or made more resilient, or otherwise "customized" precisely to suit changing conditions and the ability and needs of the skier. With a single pair of center sections and bindings and two sets of tip and tail sections, one can carry with him the equivalent of four pairs of conventional skies specifically adapted for racing, freestyle, or recreational skiing. Expensive skis need not be discarded when one is broken or damaged beyond repair. The unusable portion can be replaced.

Not unexpectedly, numerous constructions for segmented skis and means for releasably joining the component sections of such skis have been proposed. Viewed broadly, these prior art devices fall into several fairly well-defined categories.

As illustrated in U.S. Pat. No. 3,026,546, one construction mates the segments by overlapping their adjacent ends and securing one to the other by conventional means. This method may be suitable for water skiing but is unsatisfactory for snow skiing, in which the snow-contacting surface must be smooth and flat.

A second approach employs some form of interlocking mortise and tenon as the attachment means. These complex structures, as typified by U.S. Pat. No. 2,545,209, pose difficult manufacturing problems, especially with the hybrid materials and sophisticated internal construction employed in modern skis.

Another variation utilizes a butt joint, such as the mounting blocks of U.S. Pat. No. 3,819,198, to mate the segments. Skis embodying these devices, and those incorporating the previously mentioned interlocking mortise and tenon structures suffer from a number of deficiences. Some lack the structural integrity necessary for satisfactory ski performance, or suffer a loss of such integrity with wear. Some are adversely affected by the accumulation of snow, ice, and dirt. Nearly all of them require that their mating parts be manufactured to very close tolerances which are difficult to maintain. In some of them reliance is placed on critical components, such as locking screws, locating pins and the like, which may fail with catastrophic results when subjected to the high loads encountered in downhill skiing.

Another type of construction employs hinged connectors to join the segments. One such connector is shown in U.S. Pat. No. 3,884,315. Generally, skis employing such connectors cannot readily be disassembled.

The last category is typified by my U.S. Pat. No. 4,458,912, in which the adjacent segments are joined by means of an external plate or spline which is held in place by releasable clamping means. Splines, such as those shown in U.S. Pat. Nos. 1,444,996 and 3,456,968, have long been used as fasteners and connectors for furniture, however they are unsuitable for use on segmented skis. While they provide means for preventing longitudinal and lateral movement between the fastener members, they are subject to torsion, translation, bending, and rotation. This shortcoming is of little or no consequence in a device used on furniture, but in one intended for coupling ski segments, it is critical. My coupler enjoys the advantages of such prior art devices, and at the same time avoids the deficiences heretofore associated with tem.

SUMMARY OF THE INVENTION

The purpose of this invention is to provide a new and improved method and means for constructing a segmented ski having substantially the same skiing characteristics as a conventional ski.

A primary object of the invention is the provision of segmented-coupling means which can be utilized without modifying or weakening the basic internal construction of the ski and without the addition of special structures or components internal to the ski.

Another object is the provision of a construction and coupling device for segmented skis which permit the ready substitution of a variety of alternative tip and tail segments.

Still another object is the provision of a sturdy, lightweight coupling device which requires little maintenance and is not adversely affected by dirt and icing conditions. The device must be quick and easy to operate, without the need for special tools or equipment, and must provide positive locking means which are not subject to accidental release.

To achieve the aforementioned objects, I have conceived a novel coupling device for joining the segments making up a segmented ski. Essentially, the device comprises a pair of attachment members fixed to the upper surface of the abutting ends of the segments to be joined, a rigid slide bracket assembly overlapping and adapted to engage the attachment members, and tensioning means carried by the bracket assembly for securing the assembly rigidly to the attachment members. Preferably two such devices are employed on each ski, one immediately in front, and the other immediately to the rear of the central boot-supporting region of the ski, thereby allowing the skier to use a single set of bindings with a variety of tip and tail segments.

In a preferred embodiment of the invention the attachment members take the form of elongated flat rigid plates, each having an internally threaded boss thereon and a pair of upstanding flanges extending along its sides and terminating in a pair of outwardly extending lips. The bracket assembly includes a rigid plate having downwardly and inwardly turned edges defining a pair of lips adapted for loose sliding engagement with the lips of the respective attachment members. A pair of captive lock screws rotatably mounted to the bracket in registry with the threaded bosses in the attachment members pass through corresponding holes in a shim member of resilient material, preferably having a low coefficient of friction, and secure the shim member to the bracket. The edges of the shim member extend laterally into the space between the inwardly directed lips and the lower surface of the bracket for sliding engagement with the lips of the attachment plates.

When the lock screws are tightened into their respective bosses, the lips of the bracket and those of the attachment members are drawn together, comprising the intervening edges of the shim member between them and clamping the bracket and attachment members immovably in a rigid joint.

In another preferred embodiment the lips on the attachment members are directed inwardly. In this construction the bracket takes the form of a bracket body with grooves in its lateral edges adapted to loosely receive the attachment members' lips. The edges of the shim member are wrapped around the lower edges of the bracket and extend into and around the inner walls of the grooves to engage the upper surface of the lips of the attachment members.

Other objects and features of the invention, and its operation will become apparent to the reader from the following detailed description of several of its preferred embodiments as illustrated in the accompanying set of drawings.

DESCRIPTION OF THE DRAWINGS

In the drawings.

Whenever practicable the same numerals are used in the several figures to refer to the same or like components.

DETAILED DESCRIPTION OF THE PREFERRED EMBODIMENTS

Figure 1:
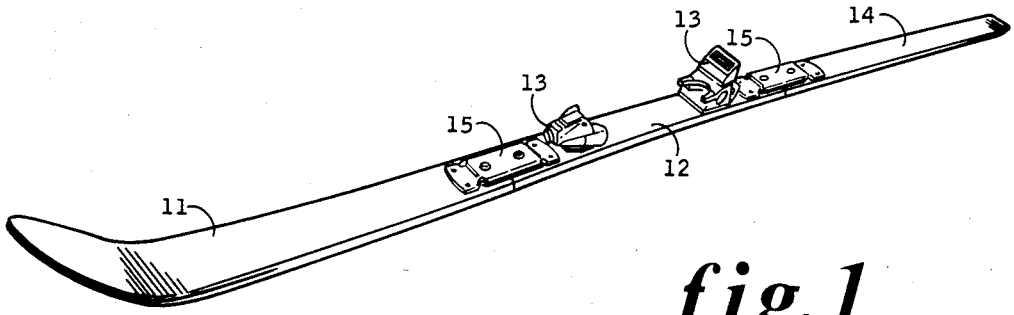
FIG. 1 is a perspective view of a typical snow ski made up of three segments joined by means of coupling devices embodying the subject invention.

FIG. 1 illustrates a ski constructed of three separable segments corresponding to the component parts of a conventional ski, namely, a tip segment 11, a center boot-supporting segment 12, to which bindings 13 are attached, and a tail segment 14. For convenience in describing the pairs of adjacent segments, in each pair the segment closer to the tip of the ski may be referred to as the "fore segment" and the segment closer to the tail as "rear segment". Similarly, the terms "fore" and "rear" may be used to designate the ends of respective segments. Segments 11 and 12 and 12 and 13 are joined, respectively, by identical coupling devices 15.

Figure 2:
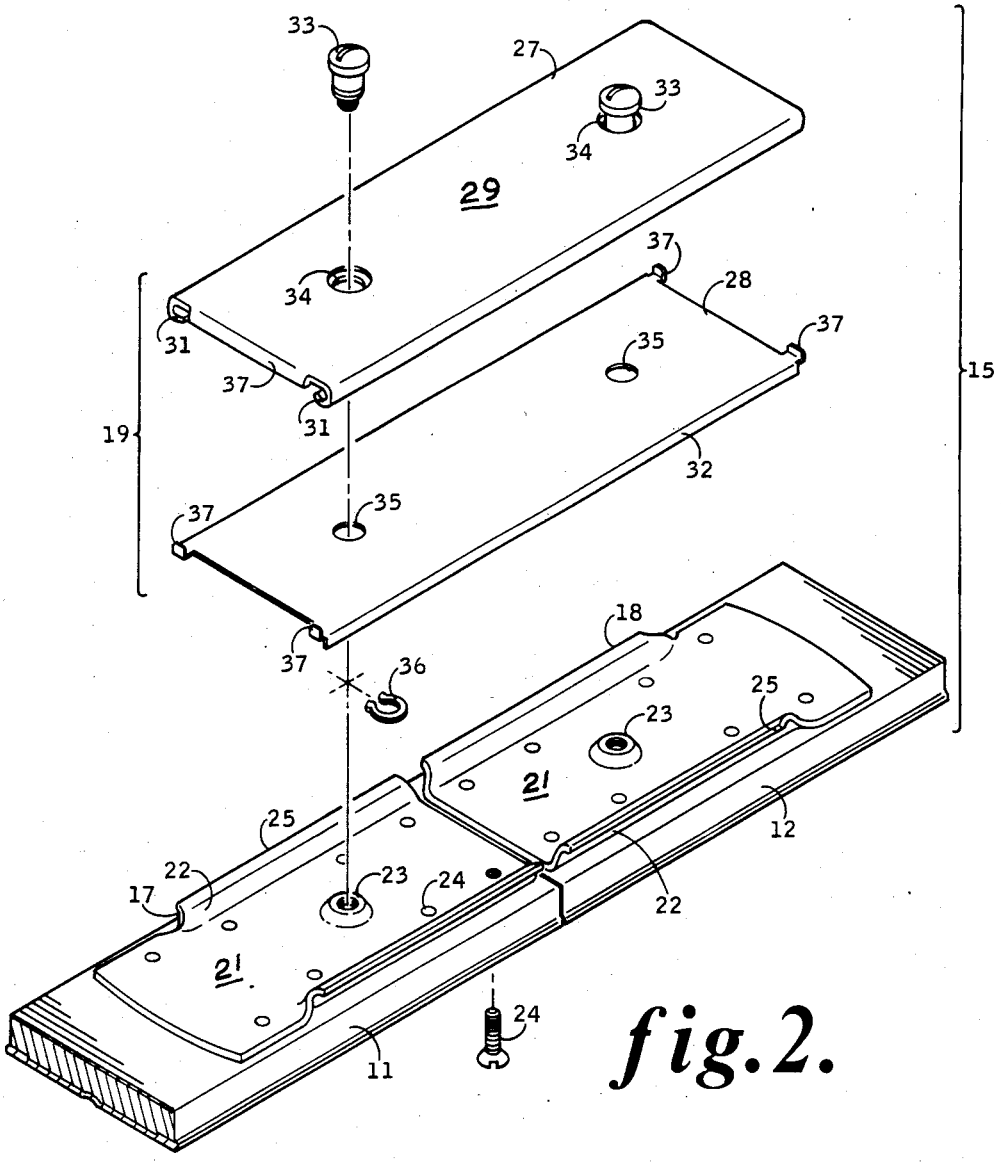
FIG. 2 is an enlarged exploded top perspective view showing the components of one of the coupling devices seen in FIG. 1.

Referring to FIG. 2, coupling device 15 includes a pair of attachment members 17, 18 and a bracket assembly 19. The attachment members 17, 18 are of rigid construction and may be formed, stamped from sheets, extruded, or machined from solid stock of steel or other appropriate material. Each attachment member 17, 18 incorporates a bottom plate 21 having upstanding flanges 22 along its edges, and a conveniently located internally threaded boss 23. Bottom plates 21 are rigidly fixed to the upper surfaces of the abutting ends of adjacent segments of the ski, as for example segments 11 and 12, by conventional means such as countersunk flathead machine screws 24.

In the embodiment illustrated in FIG. 2, the side flanges 22 terminate in outwardly directed lips 25 which are thus in axial alignment when the segments (e.g. 11, 12) are in position to be joined.

Bracket assembly 19 includes rigid bracket 27 and resilient shim member 28. Bracket 27 is formed by conventional means, preferably from sheet steel or the like, with a body 29 having downwardly and inwardly turned lips 31 along its sides. Lips 31 are adapted for loose sliding engagement with lips 25 of attachment members 17, 18 and body 29 is of a length that will substantially overlap side flanges 22 of attachment members 17, 18 when the segments 11, 12 are in abuttment. Shim member 28 is of substantially the same length as bracket 27.

Shim member 28 is conveniently formed from a sheet of polyurethane, or fluorocarbon such as "Teflon". However, it may be of any suitable resilient material ranging from a rubbery elastomer to a high-impact plastic having a low coefficient of friction at its surface enabling it to slide freely in contact with the lips 25 of attachment members 17, 18. Preferably its edges 32 are turned downwardly to conform with the inner downwardly turned walls supporting lips 31 at the sides of body 29, and provide a space between the lower surface of shim member 28 and the upper surface of lips 31 to receive lips 25 of attachment members 17, 18.

To complete the bracket assembly 19, shim member 28 is mounted to bracket 27 by means of captive screws 33 which pass through holes 34 and 35 in bracket body 29 and shim member 28, respectively, and are held in place by retainers 36 (only one shown).

Though not critical to the invention, I have found it advantageous to provide overlapping ears 37 at the ends of bracket 27 and shim member 28. Together with captive screws 33 and the frictional forces which, as will be seen, are exerted between shim member 28 and bracket body 29, ears 37 insure against relative movement between bracket 27 and shim member 28.

Figure 3:
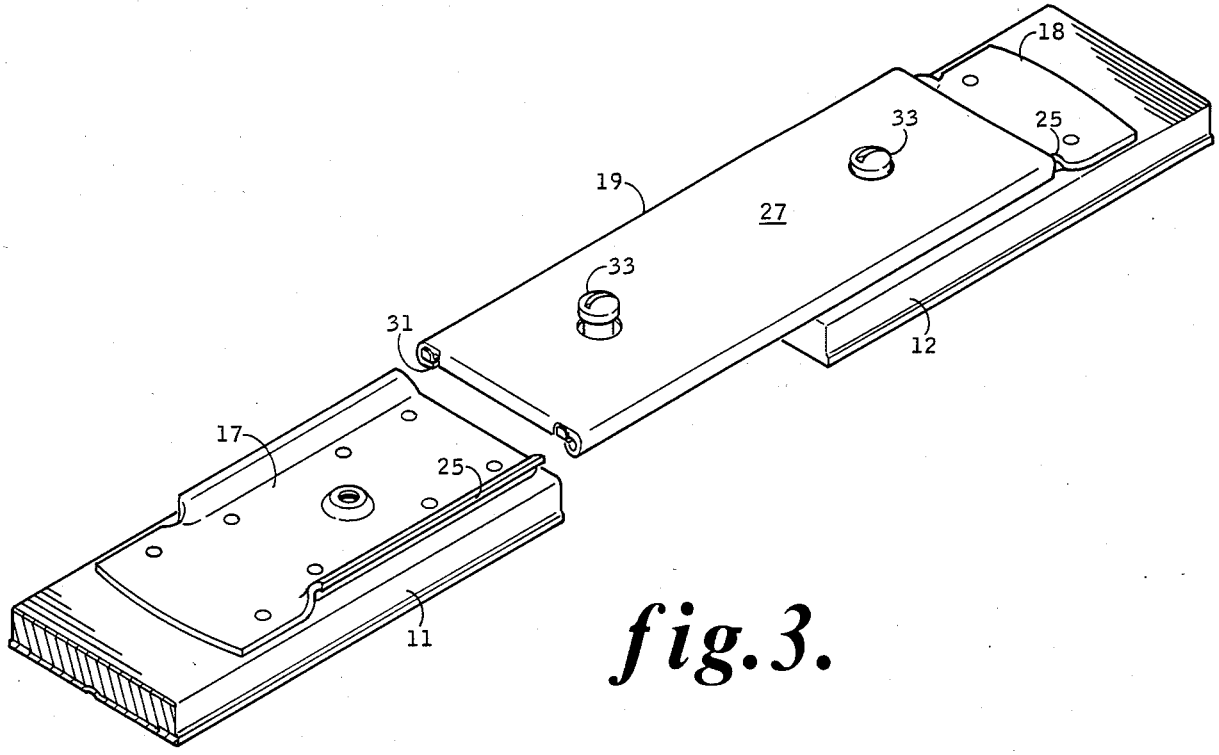
FIG. 3 is a top perspective view showing the coupling device of FIG. 2 partially assembled.
Figure 4:
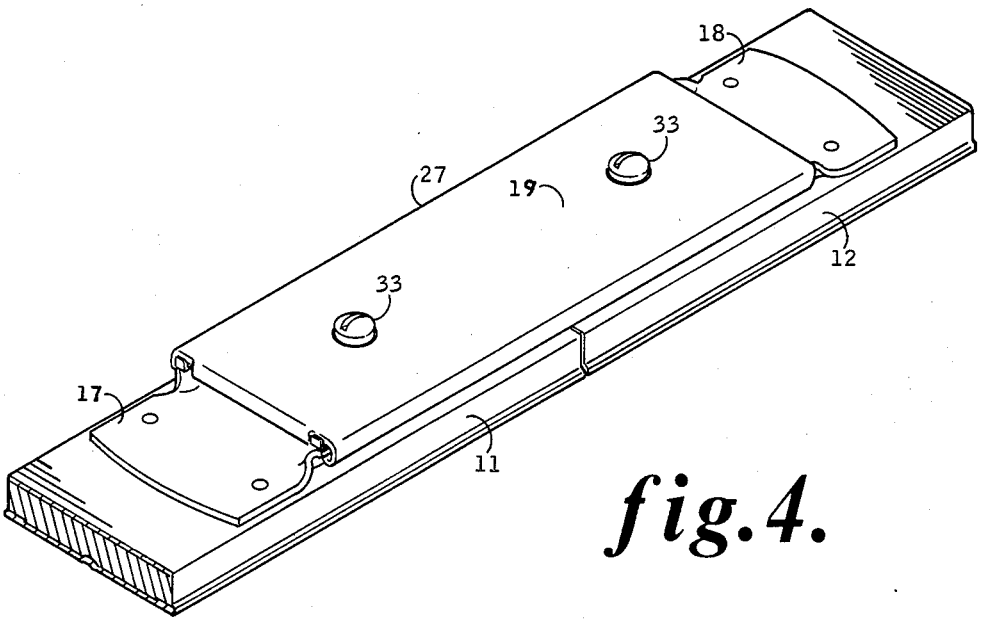
FIG. 4 is a top perspective view showing the coupling device of FIG. 2 fully assembled.

To illustrate the operation of the coupling device reference is made to FIGS. 3 and 4. As seen in FIG. 3, to assemble adjacent segments such as tip segment 11 and center segment 12, to which attachment members 17, 18 have previously been attached, bracket assembly 19 is mounted to one of the attachment members (e.g. 18) by inserting the lips 25 of attachment 18 into the space between shim member 28 and the lips 31 of bracket 27, sliding the bracket assembly 19 into a position overlapping attachment member 18, and loosely threading the overlying captive screw 33 into its corresponding boss 23 (not seen).

Most conveniently, segments 11 and 12 are placed in alignment on a flat surface and the lips 25 of attachment member 17 inserted into the space between shim member 28 and lips 31 of bracket 27, and attachment member 17 slipped into mounting engagement with bracket assembly 19 by bringing the ends of the segments 11, 12 into abuttment. The remaining screw 33 is then inserted into associated boss 23, and the two screws 33 tightened to clamp bracket assembly 19 to both of the attached members 17, 18, thereby rigidly mating the two segments 11, 12, as illustrated in FIG. 4. For a ski comprising more than two segments, the method for joining the third segment to form the completed ski is the same as that used in joining the first two segments.

Although the segments may easily be disassembled by merely releasing one of the screws in each coupling device, the characteristics of the assembled ski are vitrually identical with those of a conventional one-piece ski.

Figure 5:
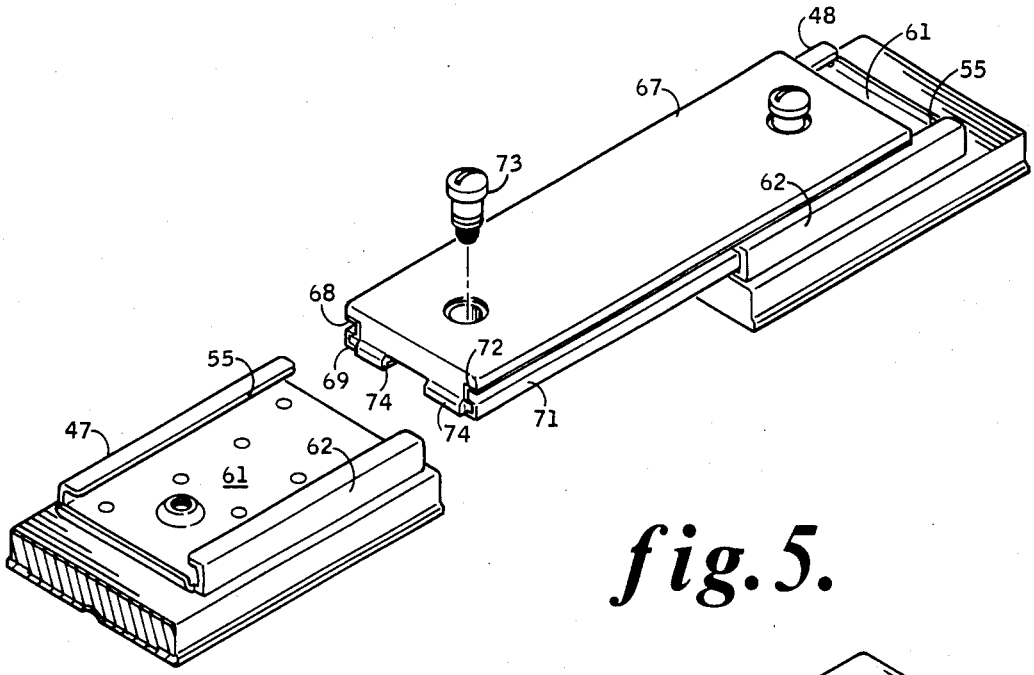
FIG. 5 is a top perspective view showing an alternative embodiment of the coupling device of the invention.

As an example of an alternative embodiment of the subject invention, FIG. 5 illustrates a coupling device in which the lips 55 project inwardly of flanges 62 formed at the sides of bottom plates 61. In this instance, the bracket 67 is provided with longitudinal grooves 68 in its sides adapted for loose engagement of lips 55. The ceilings 72 of grooves 68 define a pair of outwardly extending lips on receiver 67. Shim member 69 is extruded or formed by other conventional means with upwardly directed flanges 71 along its sides conforming to the grooves 68 in bracket 67. As in the previously described embodiment, shim member 69 is substantially the same length as bracket 67 and is mounted to the bracket by means of captive screws 73. If desired, a pair of downwardly directly ears 74 may be formed at the ends of bracket 67 to insure against longitudinal movement of shim member 69 with respect to bracket 67.

Figure 6:
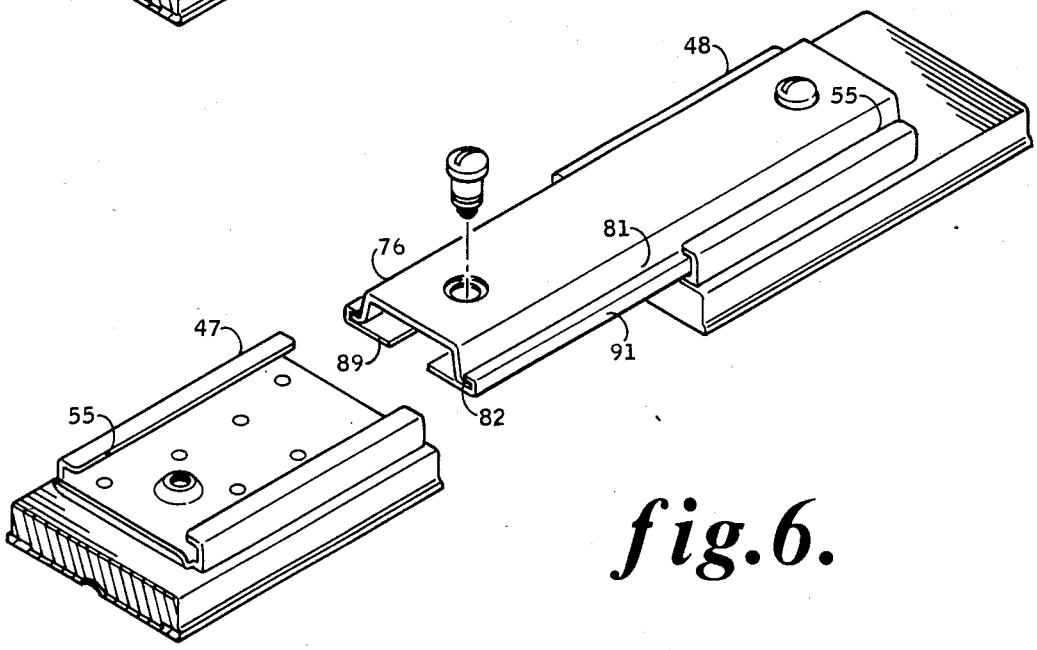
FIG. 6 is a top perspective view showing another alternative embodiment of the coupling device of the invention.

In the alternative embodiment of the invention illustrated in FIG. 6, attachment members 47, 48 are substantially identical with those shown in the embodiment of FIG. 5. Here, however, the bracket 76 is formed by conventional means with flanges 81 extending downwardly and terminating in outwardly directed lips 82 adapted for loose sliding engagement with the lips 55 of attachment members 47, 48. Shim member 89 is substantially coextensive with bracket 76 and is formed with upstanding flanges 91 along its sides conforming closely with lips 82.

The operation of the embodiments of FIG. 5 and FIG. 6 is the same as that described for the embodiments of FIGS. 2–4, in which case the result of tightening screws 33 or 73 being the clamping the bracket 27 or 67 to the attachment members 17, 18 or 47, 48, respectively, to form a rigid joint connecting the ski segments.

While I have described the invention in terms of several preferred embodiments, it is not to be construed as limited to those embodiments, and they are to be regarded as illustrative rather than restrictive. It is my intention by this specification to cover any and all variations of the examples I have chosen for purposes of the disclosure, which do not depart from the spirit and scope of the following claims.

I claim:

1. A segmented ski having at least two segments, comprising:

a fore segment and a rear segment adapted for end-to-end abutment;

a first attachment member secured to the top of the fore segment at the rear end thereof, said first attachment member including a bottom plate having an internally threaded boss thereon and a pair of side flanges extending upwardly of said plate and terminating in a pair of first lips lying in a plane substantially parallel to the top of said ski;

a second attachment member secured to the top of the rear segment at the fore end thereof, said second attachment member including a bottom plate having an internally threaded boss thereon and a pair of side flanges extending upwardly of said plate and terminating in a pair of second lips lying in the plane containing said first lips and in longitudinal alignment with said first lips;

a bracket releasably connecting said attachment members, said bracket including a rigid body having a pair of third lips formed along the sides thereof and spaced from said first and second lips;

a shim member mounted to said bracket, the edges of said shim member being interposed between said third lips and said first and second lips, respectively, and being longitudinally substantially coextensive with said first and second lips; and a pair of screws rotatably mounted to said bracket in registry with said threaded bosses, said screws forcing said first and second lips and said third lips into clamping engagement with the intervening edges of said shim member and thereby rigidly securing said bracket to said attachment members.

2. The segmented ski of claim 1, wherein said shim member is of resilient material having a low coefficient of friction at its surface.

3. The segmented ski of claim 2, wherein said first and second lips extend outwardly of the side flanges of said first and second attachment members, and said third lips extend inwardly of the sides of said bracket.

4. A coupling device for releasably coupling the respective fore and rear segments of adjacent pairs of segments in a segmented ski having at least two segments adapted for end-to-end abutment, comprising:

a first attachment member secured to the top of the fore segment at the rear end thereof, said first attachment member including a bottom plate having an internally threaded boss thereon and a pair of side flanges extending upwardly of said plate and terminating in a pair of first lips lying in a plane substantially parallel to the top of said ski;

a second attachment member secured to the top of the rear segment at the fore end thereof, said second attachment member including a bottom plate having an internally threaded boss thereon and a pair of side flanges extending upwardly of said plate and terminating in a pair of second lips lying in the plane containing said first lips and in alignment with said first lips;

a bracket releasably connecting said attachment members, said bracket including a rigid body having a pair of third lips formed along the sides thereof and spaced from said first and second lips;

a shim member mounted to said bracket, the edges of said shim member being interposed between said third lips and said first and second lips, respectively, and being longitudinally substantially coextensive with said first and second lips; and a pair of screws rotatably mounted to said bracket in registry with said threaded bosses, said screws forcing said first and second lips and said third lips into clamping engagement with the intervening edges of said shim member and thereby rigidly securing said bracket to said attachment members.

5. The coupling device of claim 4, wherein said shim member is of resilient material having a low coefficient of friction at its surface.

6. The coupling device of claim 5, wherein said first and second lips extend outwardly of the side flanges of said first and second attachment members, and said third lips extend inwardly of the sides of said bracket.

* * * * *